US008074838B1

(12) United States Patent
Tate

(10) Patent No.: US 8,074,838 B1
(45) Date of Patent: Dec. 13, 2011

(54) COMBINED WATER GUN AND WATER BALLOON LAUNCHER AND ASSOCIATED METHOD

(76) Inventor: Shawn Tate, Baltimore, MD (US)

( * ) Notice: Subject to any disclaimer, the term of this patent is extended or adjusted under 35 U.S.C. 154(b) by 648 days.

(21) Appl. No.: 12/221,671

(22) Filed: Aug. 5, 2008

Related U.S. Application Data

(60) Provisional application No. 60/963,374, filed on Aug. 6, 2007.

(51) Int. Cl.
*F41B 9/00* (2006.01)

(52) U.S. Cl. ..... 222/79; 222/78; 222/96; 222/429; 222/475; 222/483; 446/211; 446/267; 446/473

(58) Field of Classification Search ..... 222/78, 222/79, 176, 96, 429, 475, 483; 446/473, 446/267, 211
See application file for complete search history.

(56) References Cited

U.S. PATENT DOCUMENTS 3,163,330 A * 12/1964 Ryan ..... 222/79
3,575,318 A * 4/1971 Kunz ..... 222/79
4,134,228 A * 1/1979 Ortiz ..... 446/225
4,257,460 A * 3/1981 Paranay et al. ..... 141/26
4,735,239 A * 4/1988 Salmon et al. ..... 141/25
5,158,208 A * 10/1992 Wilson ..... 222/78
5,238,149 A * 8/1993 Johnson et al. ..... 222/79
5,241,944 A * 9/1993 Rappaport ..... 124/67
5,284,274 A * 2/1994 Lee et al. ..... 222/79
5,305,919 A * 4/1994 Johnson et al. ..... 222/79
5,354,225 A * 10/1994 Hix ..... 446/180
5,366,108 A * 11/1994 Darling ..... 222/1
5,373,832 A * 12/1994 D'Andrade ..... 124/69
5,381,928 A * 1/1995 Lee et al. ..... 222/79
5,433,646 A * 7/1995 Tarng ..... 446/473
5,529,525 A * 6/1996 Deal ..... 446/473
5,531,627 A * 7/1996 Deal ..... 446/473
5,538,457 A * 7/1996 Deal ..... 446/473
5,603,361 A * 2/1997 Cuisinier ..... 141/26
5,850,941 A * 12/1998 Johnson et al. ..... 222/79
5,875,927 A * 3/1999 D'Andrade ..... 222/79
5,906,295 A * 5/1999 D'Andrade ..... 222/79
6,012,609 A * 1/2000 D'Andrade ..... 222/79
6,123,229 A * 9/2000 Barish ..... 222/79
6,138,871 A * 10/2000 D'Andrade ..... 222/79
6,158,619 A * 12/2000 D'Andrade et al. ..... 222/79
6,167,925 B1 * 1/2001 D'Andrade ..... 141/348
6,193,107 B1 * 2/2001 D'Andrade ..... 222/79
6,203,397 B1 * 3/2001 Applewhite et al. ..... 446/475
6,234,347 B1 * 5/2001 Amron ..... 222/1
6,257,448 B1 * 7/2001 D'Andrade et al. ..... 222/79
6,279,562 B1 * 8/2001 Clayton ..... 124/59
6,345,732 B1 * 2/2002 Zimmerman et al. ..... 222/79

(Continued)

*Primary Examiner* — Gene Kim
*Assistant Examiner* — Alexander Niconovich

(57) ABSTRACT

The combined water balloon launcher and water discharging device preferably includes a mechanism for discharging water. A water-holding reservoir may be mounted onto a handle section. A first barrel may also be coupled to the handle section. The first barrel may have an inlet port formed at a proximal end thereof in fluid communication with the water-holding reservoir. A guard may be coupled to a first plunger and may be slidably seated about the first and second barrels. The first plunger may displace air from the air holding chamber into the water holding reservoir. The water balloon launching mechanism may include a second barrel and a revolving water balloon-holding drum. The drum may contain isolated chambers in which water balloons are loaded. A second spring member may be anchored to the handle and attached to a second plunger. The second plunger urges the water balloon outwardly from the second barrel.

13 Claims, 9 Drawing Sheets

U.S. PATENT DOCUMENTS

| | | | | |
|---|---|---|---|---|
| 6,439,216 | B1 * | 8/2002 | Johnson et al. | 124/70 |
| 6,651,702 | B2 * | 11/2003 | Marino | 141/26 |
| 6,658,779 | B2 * | 12/2003 | Bauer et al. | 42/1.08 |
| 6,929,151 | B1 * | 8/2005 | Clayton | 222/79 |
| 6,994,126 | B2 * | 2/2006 | Marino | 141/26 |
| 7,025,228 | B2 * | 4/2006 | Cuisinier | 222/79 |
| 7,185,787 | B2 * | 3/2007 | Brown et al. | 222/79 |
| 7,219,817 | B2 * | 5/2007 | Panzarella | 222/386 |
| 7,267,118 | B2 * | 9/2007 | Eddins et al. | 124/63 |
| 7,686,002 | B2 * | 3/2010 | Andrews | 124/65 |
| 7,726,292 | B1 * | 6/2010 | Coleman | 124/27 |
| 7,731,061 | B1 * | 6/2010 | Woodhouse et al. | 222/175 |
| 2003/0010401 | A1 * | 1/2003 | Marino | 141/383 |
| 2004/0045981 | A1 * | 3/2004 | Marino | 222/79 |
| 2004/0112987 | A1 * | 6/2004 | Baker | 239/525 |
| 2004/0206771 | A1 * | 10/2004 | Junkel | 222/78 |
| 2005/0072412 | A1 * | 4/2005 | Cuisinier | 124/1 |
| 2005/0167442 | A1 * | 8/2005 | Cuisinier | 222/79 |
| 2006/0081645 | A1 * | 4/2006 | Junkel | 222/78 |
| 2006/0097004 | A1 * | 5/2006 | Junkel | 222/78 |
| 2007/0000942 | A1 * | 1/2007 | Wong et al. | 222/79 |

* cited by examiner

COMBINED WATER GUN AND WATER BALLOON LAUNCHER AND ASSOCIATED METHOD

CROSS REFERENCE TO RELATED APPLICATIONS

This application claims the benefit of U.S. Provisional Application No. 60/963,374, filed Aug. 6, 2007, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to water toys and, more particularly, to a combined water balloon launcher and water discharging device for providing user enjoyment.

2. Prior Art

In the past, amusement devices such as water guns have been provided which are carried by the user and which are hand-held for operation. Normally, the device takes the form of a gun which includes a water reservoir and a trigger operated pump for forcing the water from the reservoir through a discharge orifice or nozzle. Usually, the reservoir is connected to the nozzle via a plurality of tubes which are interconnected via the pump. It is also known in the prior art to fill latex balloons with water and toss them at each other as a form of entertainment, especially on warm summer days.

The prior art examples do not specifically address the problems solved by the combined water balloon launcher and water discharging device of the present invention. Other inventions may either only discharge water along a trajectory or launch a water balloon along a trajectory.

U.S. Pat. No. 3,575,318 to Kunz discloses an apparatus wherein a squirt gun member includes a conduit in fluid communication with a housing, wherein the housing is arranged for mounting to a torso portion of an individual utilizing a waist and shoulder strap arrangement. A modified gun construction of the instant invention utilizes a projected balloon member formed with a tether line mounted to the gun structure of the instant invention. Unfortunately, this prior art examples does not provide the user with an effective means of simultaneously discharging water and launching water balloons.

U.S. Pat. No. 4,257,460 to Parana discloses a water gun having a body formed with a central bore opening at its opposite ends to provide a discharge nozzle at one end of the body and a storage compartment or reservoir end at the opposite end of the body. The storage compartment end is adapted to releasably hold the end of an inflatable member which when loaded with water under pressure, expands so as to stretch the membrane of the inflatable storage compartment. Upon termination of the loading pressure, the inflatable member collapses under its own elasticity to discharge the stored water via the nozzle end of the body. A clamping device is employed for detachably connecting the inflatable storage compartment to its respective end of the body and a trigger mechanism may be employed for selectively releasing the pressurized water within the storage compartment. Unfortunately, this prior art examples fails to provide the user with a means to launch a water balloon along a trajectory path.

U.S. Pat. No. 5,603,361 to Cuisiniear discloses portable dispenser adapted to filling water balloons and water pistols. A reservoir is pressurized by a hand pump that draws air in from the atmosphere and forces the air into the reservoir. The pressure in the reservoir forces water down a flexible tube to a trigger mechanism in a water pistol. The trigger mechanism performs three functions: it throttles the water, it acts as relief valve by releasing water if the pressure is greater than a predetermined limit, and it indicates the pressure within the reservoir. When the trigger mechanism is actuated, water flows through the mechanism to a valve that directs the water either to a filling nozzle or to a spraying nozzle. In an alternative embodiment, the pump takes water from a storage chamber within the reservoir and pumps it into a high pressure chamber within the reservoir. Unfortunately, this prior art example fails in providing a user with a means to discharge water along a trajectory.

Accordingly, a need remains for a combined water balloon launcher and water discharging device in order to overcome the above-noted shortcomings. The present invention satisfies such a need by providing a device that is convenient and easy to use, is durable yet lightweight in design, is versatile in its applications, and provides users with a new and exciting way in which to enjoy the classic game of tossing water balloon.

BRIEF SUMMARY OF THE INVENTION

In view of the foregoing background, it is therefore an object of the present invention to provide a device for providing user enjoyment. These and other objects, features, and advantages of the invention are provided by a combined water balloon launcher and water discharging device.

The combined water balloon launcher and water discharging device preferably includes a handle section. Such a handle section may include a trigger pivotally connected thereto. The device may also include a mechanism for discharging a stream of water along a first trajectory. The device may further include a mechanism for launching a water balloon along a second trajectory. Conveniently, the water discharging mechanism and the water balloon launching mechanism are automatically released from corresponding cocked positions when the trigger is depressed to a single engaged position.

The water discharging mechanism preferably includes a water-holding reservoir, containing a first volume of water therein, mounted on the handle section. The water discharging mechanism may also include an air-holding chamber in fluid communication with the water-holding reservoir for directing air into the water-holding reservoir. Additionally, a first barrel is preferably coupled to the handle section. Such a first barrel may include an inlet port formed at a proximal end thereof in fluid communication with the water-holding reservoir.

The water discharging mechanism may also include a guard slidably seated about the first and second barrels respectively. Such a guard is preferably manually reciprocated along a linear path extending parallel to the first and second barrels respectively. A first plunger may be coupled to the guard. Such a first plunger may also include a proximal end telescopically reciprocated inside the air-holding chamber as the guard is linearly reciprocated towards and away from the handle.

A spring-tensioned first flap may preferably be pivotally situated within the air-holding chamber and situated along a corresponding travel path of the first plunger. Such a first flap may be resiliently articulated along a first arcuate path when the first plunger is proximally displaced within the air-holding chamber. The first plunger may effectively force the first flap to an open position when the first plunger reaches a terminal end of the corresponding travel path such that air is introduced into the air-holding chamber and retained downstream of the first flap. The first flap may then automatically return to a closed equilibrium position as the first plunger is retracted distally inside the air-holding chamber.

The first plunger preferably includes a washer attached to an outer perimeter of the proximal end thereof. Such a washer may maintain continuous surface area contact with an interior wall of the air-holding chamber located upstream of the first flap and thereby maximizing air-displacement downstream of the first flap during reciprocating movements of the first plunger. The proximal end of the first plunger may also advantageously remain permanently seated within the air-chamber while guard is linearly reciprocated towards and away from the air-holding chamber respectively.

The handle section preferably includes a first spring member anchored to the trigger and an inner wall of the handle section respectively. The first spring member may be linearly reciprocated between extended and equilibrium positions respectively defined along a travel path obliquely offset from the corresponding travel path of the first plunger. A piston is preferably slidably interfitted within the air-holding chamber. Such a piston may maintain continuous contact with an inner wall located downstream of the first flap. The piston may also be pivotally attached to a proximal end of the trigger and may further be linearly reciprocated along a corresponding travel path such that the piston effectively permits air to escape out from the air-holding chamber and directly enter the water-holding reservoir when the piston is elevated to a raised position.

The water discharging mechanism preferably further includes a spring-tensioned second flap pivotally connected to the first barrel. Such a second flap may be situated at the inlet port. The second flap may also remain closed at equilibrium and may further be resiliently biased to an open position when a second volume of water is forced out of the water-holding reservoir as air enters the water-holding reservoir. Conveniently, the second volume of water is displaced along an entire longitudinal length of the first barrel. In this manner, the second volume of water is discharged along the first barrel and out of the device along a trajectory.

The water balloon launching mechanism preferably includes a second barrel extending parallel to the first barrel which is isolated therefrom such that the first and second water volumes are prohibited from entering the second barrel. The water balloon launching mechanism may also include a revolving water balloon-holding drum. Such a revolving drum may include a plurality of isolated chambers juxtaposed side-by-side along a circumferential path thereof.

Each of such chambers preferably includes an open proximal end selectively positioned within the second barrel and independently oriented in line with the second trajectory respectively. The revolving drum may be suitably sized and shaped for simultaneously holding one of the water balloons within each of the chambers respectively such that a new one of the chambers becomes axially aligned along the second trajectory when the revolving drum is rotated. In this manner, each chamber of the revolving drum effectively cooperates with the second barrel, enabling a user to launch a series of water balloons without being required to load each water balloon into the second barrel after each shot.

The water balloon launching mechanism preferably further includes a second spring member anchored inside the second barrel. Such a second spring member may be arranged to linearly reciprocate between associated compressed and equilibrium positions respectively defined along a linear travel path extending within the second barrel The water balloon launching mechanism may also include a second plunger slidably interfitted within the second barrel. Such a second plunger is preferably directly attached to a distal end of the second spring member. The second plunger may further be displaced from the associated cocked position to an associated equilibrium position such that the second plunger distally urges the water balloon outwardly from the second barrel and along the second trajectory extending away from a corresponding one of the chambers respectively.

The water balloon launching mechanism may also preferably include a plurality of linear slots formed within an outer surface of the revolving drum and traveling parallel to a longitudinal length of the chambers respectively. A plurality of reset levers may traverse through the slots and maintain direct abutment with the second plunger. Such reset levers may proximally urge the second plunger back to the cocked position when the reset levers are linearly returned to a retracted position located proximal to the revolving drum.

The water balloon launching mechanism preferably further includes a ring pivotally coupled to a distal end of the trigger. Such a ring may be biased along an arcuate path as the trigger is toggled to and from the single cocked position. An elongated and linear actuating lever may have a proximal end pivotally mated with the ring. Such an actuating lever is preferably linearly reciprocated along a travel path registered parallel to the longitudinal length of the second barrel as the ring is biased along the arcuate path.

The water balloon launching mechanism may further include a hinge with a locking finger releasably maintaining a frictional engagement with the second plunger. Such a locking finger may be advantageously articulated to an unlocked position and thereby disengaged from the second plunger when the actuating lever is urged distally along the longitudinal length of the second barrel such that the second plunger is released from the corresponding cocked position and launches the water-balloon along the second trajectory. The actuating lever may automatically return to the retracted position while the locking finger remains at the unlocked position. The second plunger may effectively articulate the locking finger back to the frictional engagement with the second plunger when the reset levers are returned to corresponding cocked positions respectively.

The first plunger is preferably located upstream of the second plunger so that the first plunger introduces air into the air-holding chamber independent of whether the second plunger is cocked or released.

A method for launching a water balloon and discharging water may include the first step of providing a handle section including a trigger pivotally connected thereto. The method may also include the second step of providing a mechanism for discharging a stream of water along a first trajectory. The method may further include the third step of providing a mechanism for launching a water balloon along a second trajectory.

The method may further include the fourth step of simultaneously launching and discharging the water balloon and the water along the first and second trajectories respectively when the trigger is depressed to a single engaged position by automatically releasing the water discharging mechanism and the water balloon launching mechanism from corresponding cocked positions when the trigger is depressed to the single engaged position.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
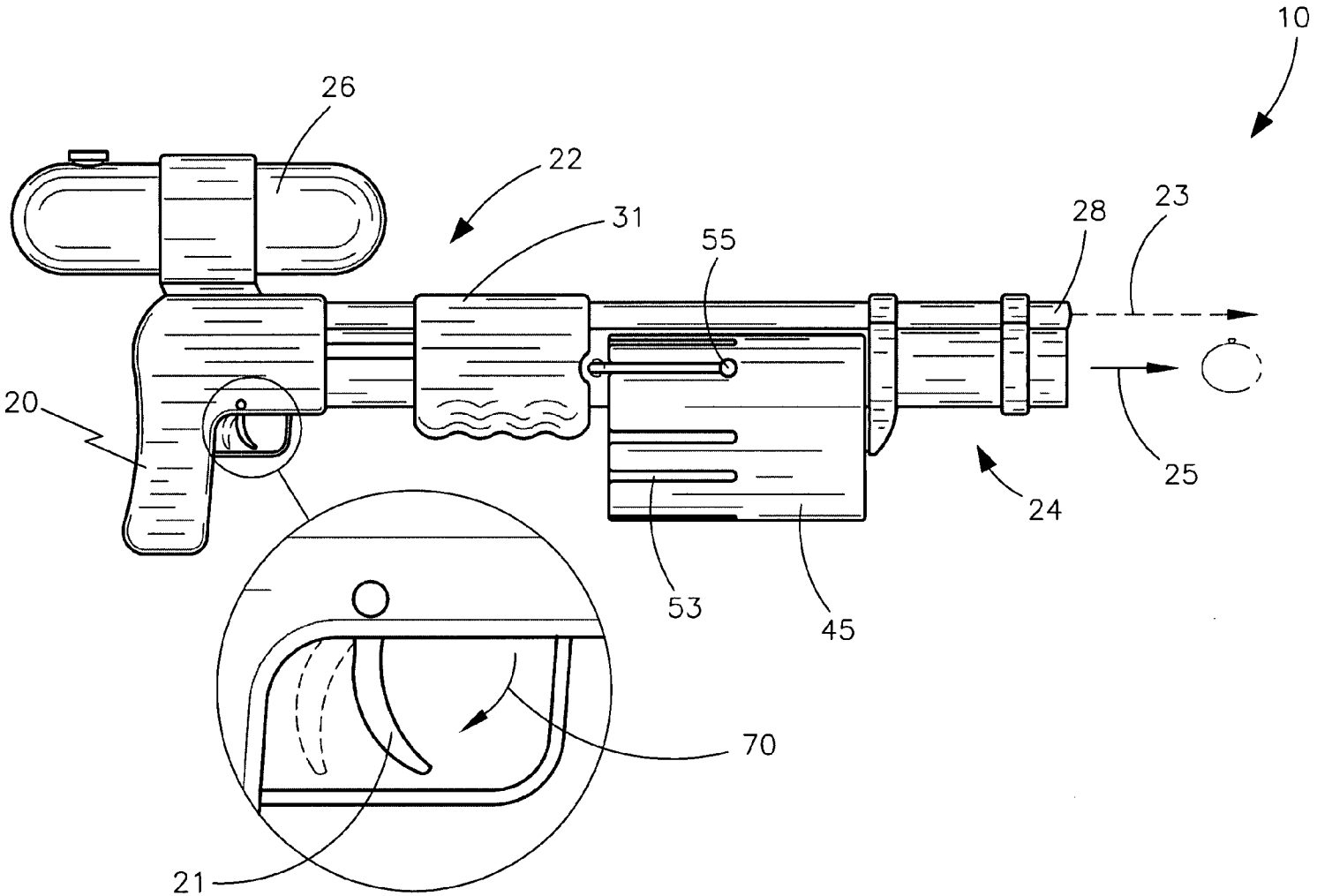
FIG. 1 is a side elevational view of a combined water balloon launcher and water discharging device showing an enlarged view of the trigger, in accordance with the present invention.
Figure 2:
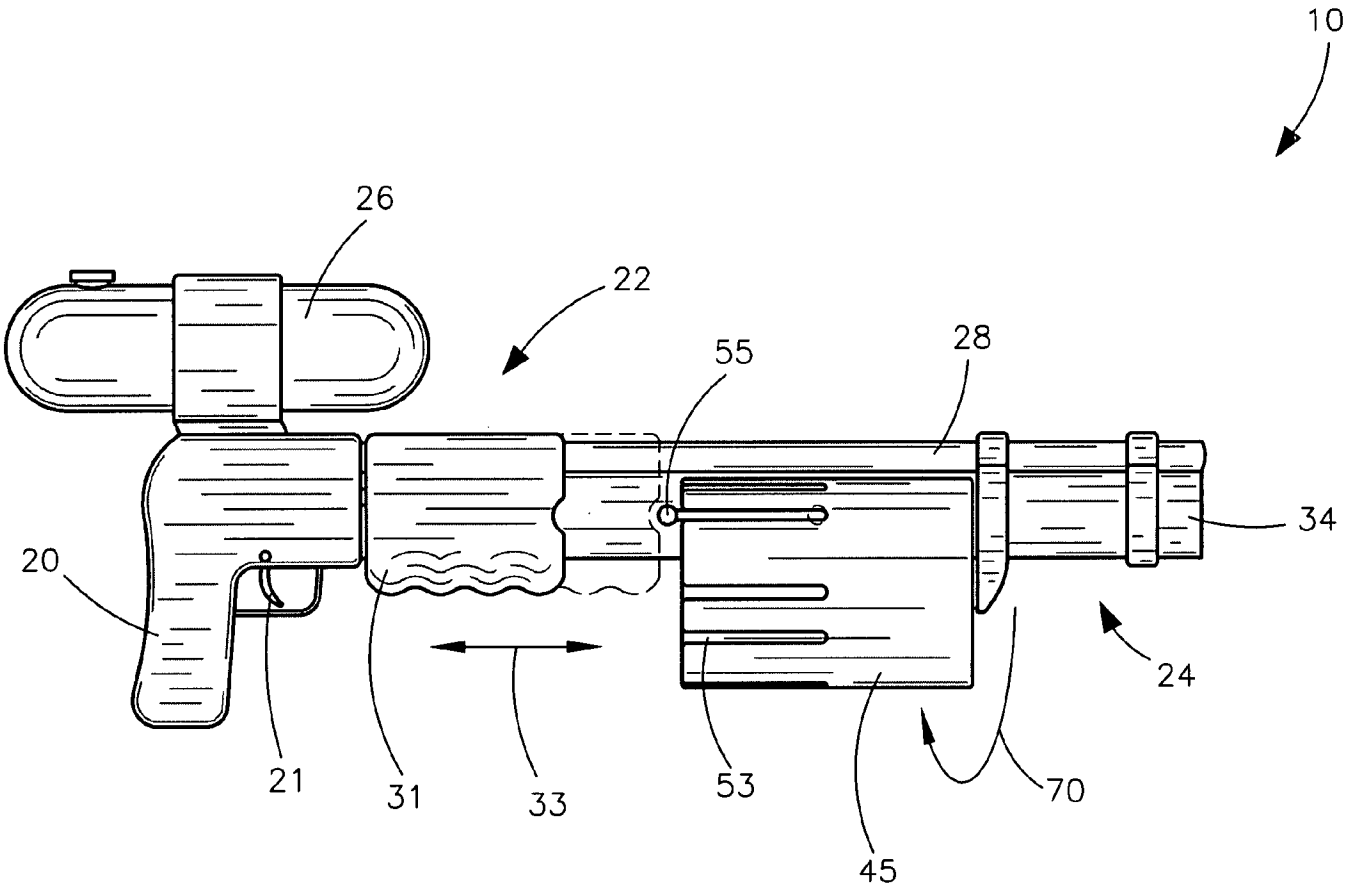
FIG. 2 is a side elevational view of the present invention showing the rotation of the water balloon holding drum and the linear travel path of the guard.
Figure 3:
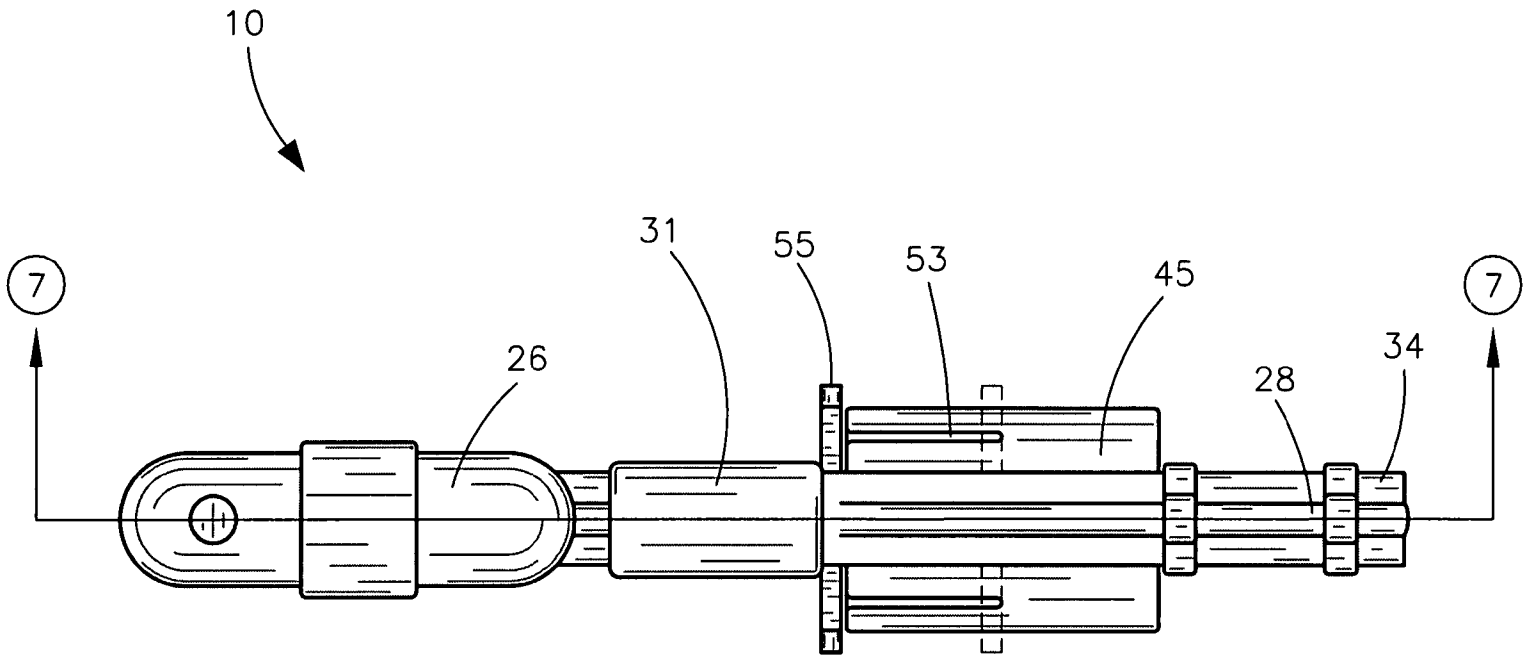
FIG. 3 is top plan view of the present invention showing the linear movement of the reset levers.
Figure 4:
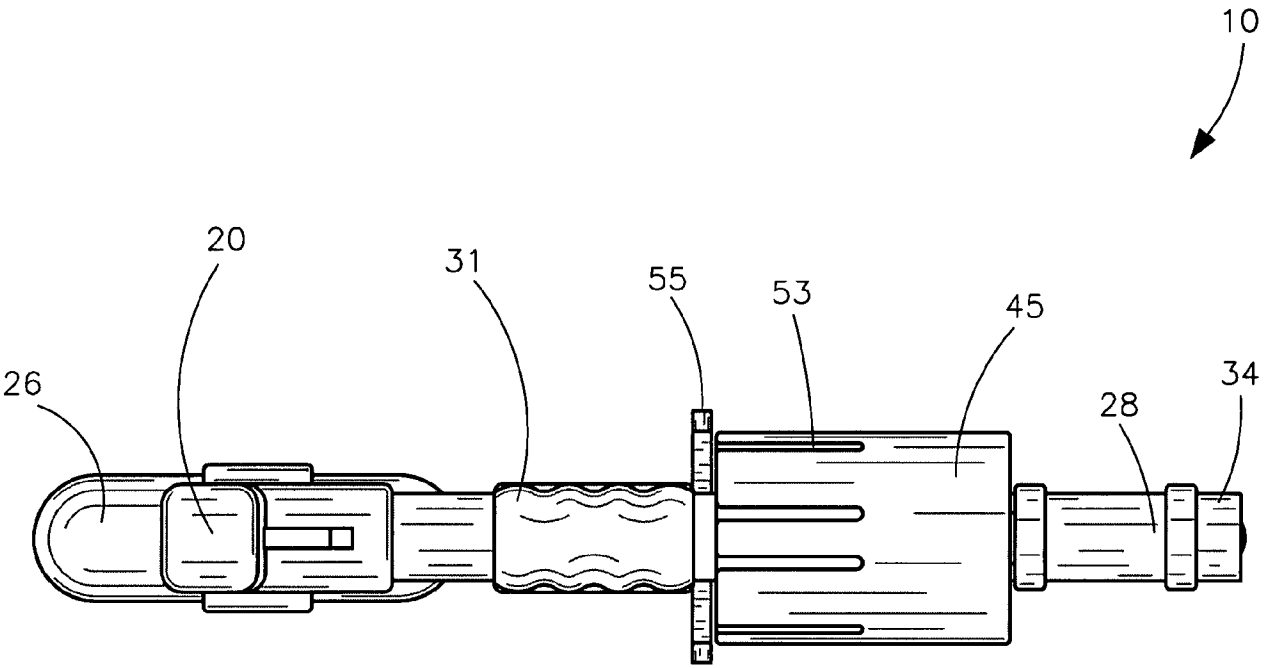
FIG. 4 is a bottom plan view of the present invention showing the linear slots formed within the revolving water balloon holding drum.
Figure 5:
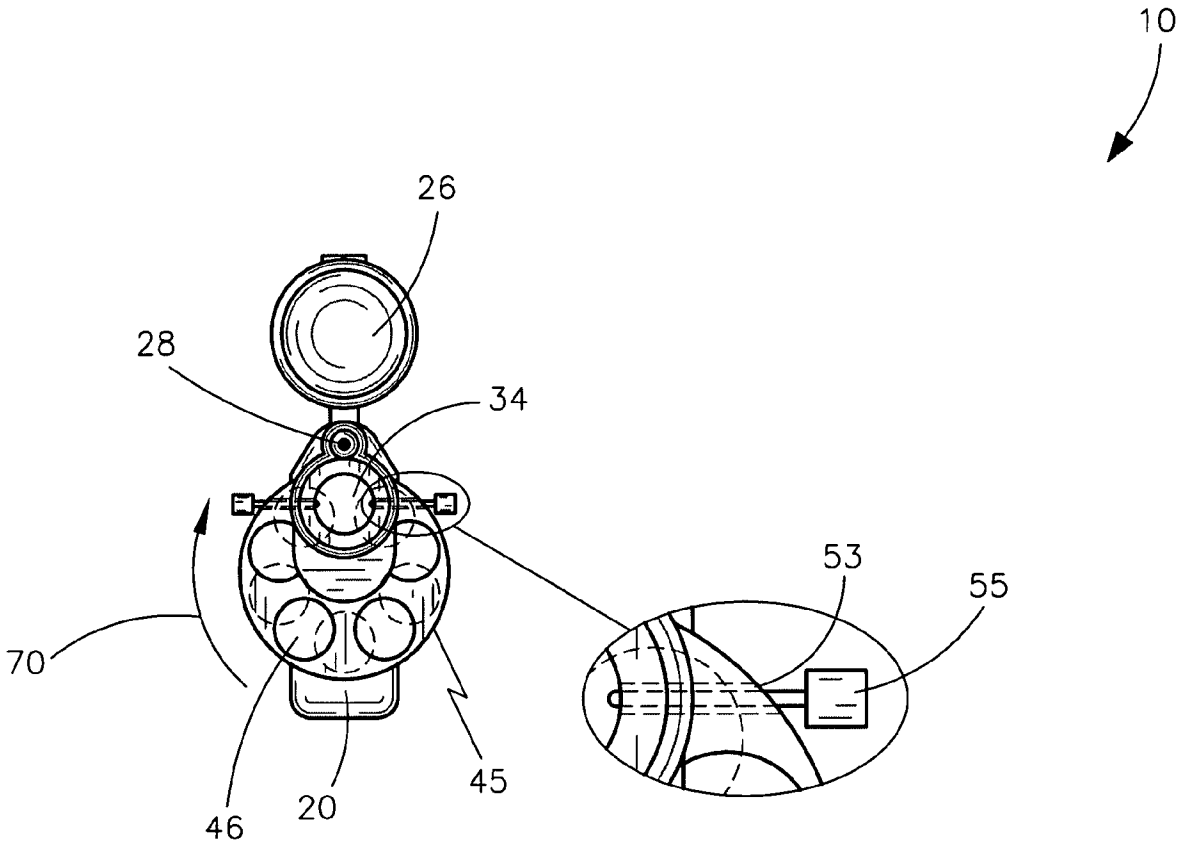
FIG. 5 is a front elevational view of the present invention showing an enlarged detailed view of the reset levers.
Figure 6:
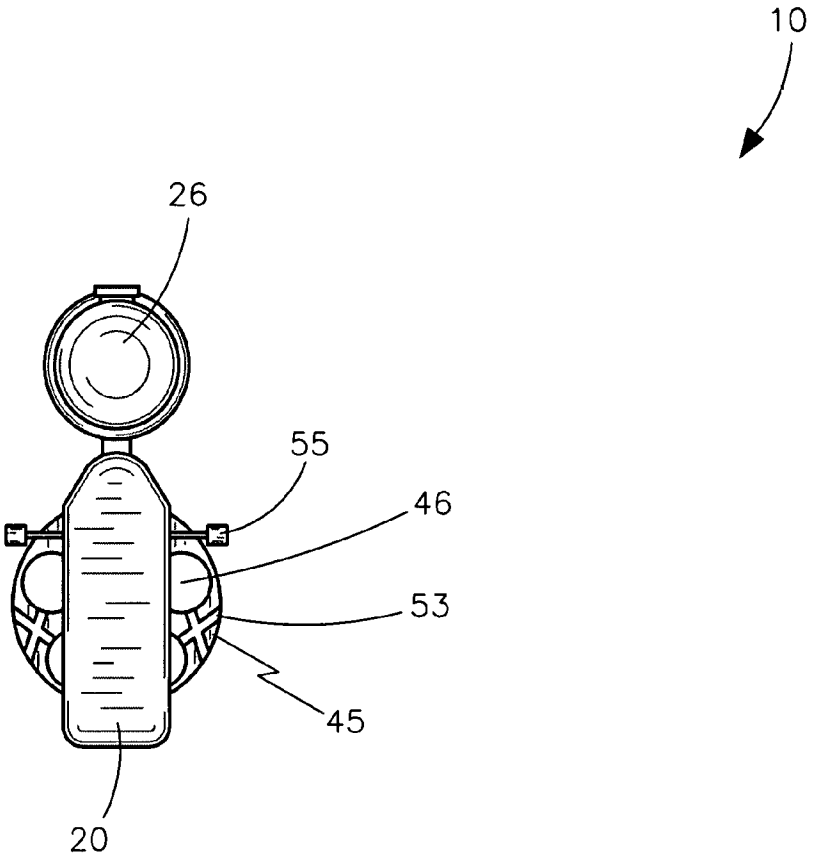
FIG. 6 is a rear elevational view of the present invention showing the orientation of the linear slots formed into the water balloon holding drum.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The device of this invention is referred to generally in FIGS. 1-7C by the reference numeral 10 and is intended to provide a combined water balloon launcher and water discharging device 10 for providing user enjoyment. It should be understood that the device 10 may be used to provide enjoyment for many different types of users and should not be limited in use to the applications mentioned herein.

Referring initially to FIGS. 1-7C, the combined water balloon launcher and water discharging device 10 preferably includes a handle 20 section. Such a handle 20 section may include a trigger 21 pivotally connected thereto. Such a trigger may follow a mutually exclusive arcuate path 71. The device 10 may also include a mechanism 22 for discharging a stream of water along a first trajectory 23. The device 10 may further include a mechanism 24 for launching a water balloon along a second trajectory 25. In this manner, the present invention provides users with a fun and thrilling alternative to throwing water balloons by hand.

Conveniently, the water discharging mechanism 22 and the water balloon launching mechanism 24 are automatically released from corresponding cocked positions when the trigger 21 is depressed to a single engaged position. This feature overcomes shortcomings associated with prior art examples wherein only a stream of water is discharged. With the present invention, both a stream of water and a water balloon may be simultaneously discharged thereby increasing user enjoyment.

Figure 7A:
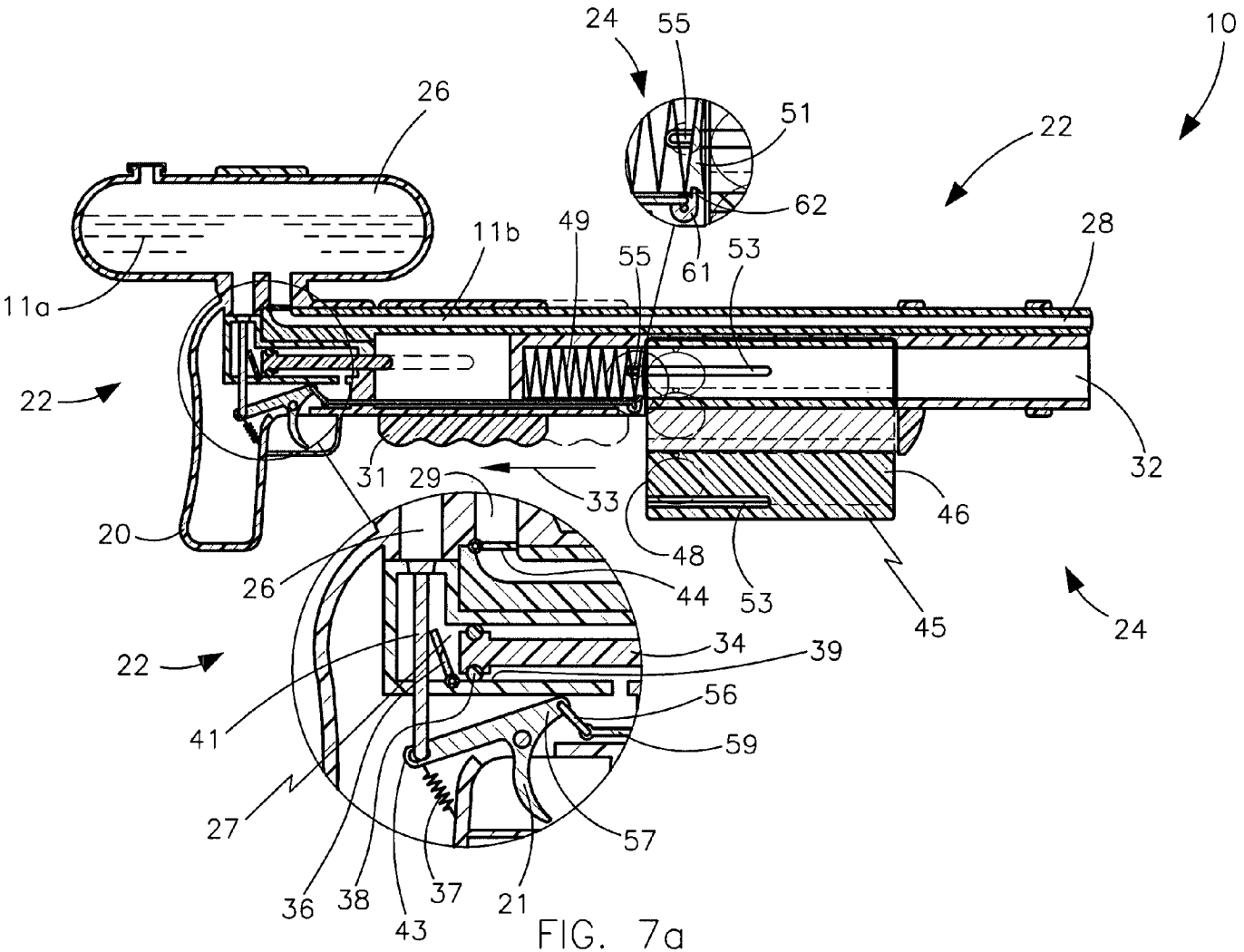
FIG. 7A is a cross sectional view of the present invention showing an exploded detailed view of the trigger and a detailed view of the hinge when the second plunger is in a cocked position and the first plunger is positioned at a proximate position, taken along line 7-7, as seen in FIG. 3.
Figure 7B:
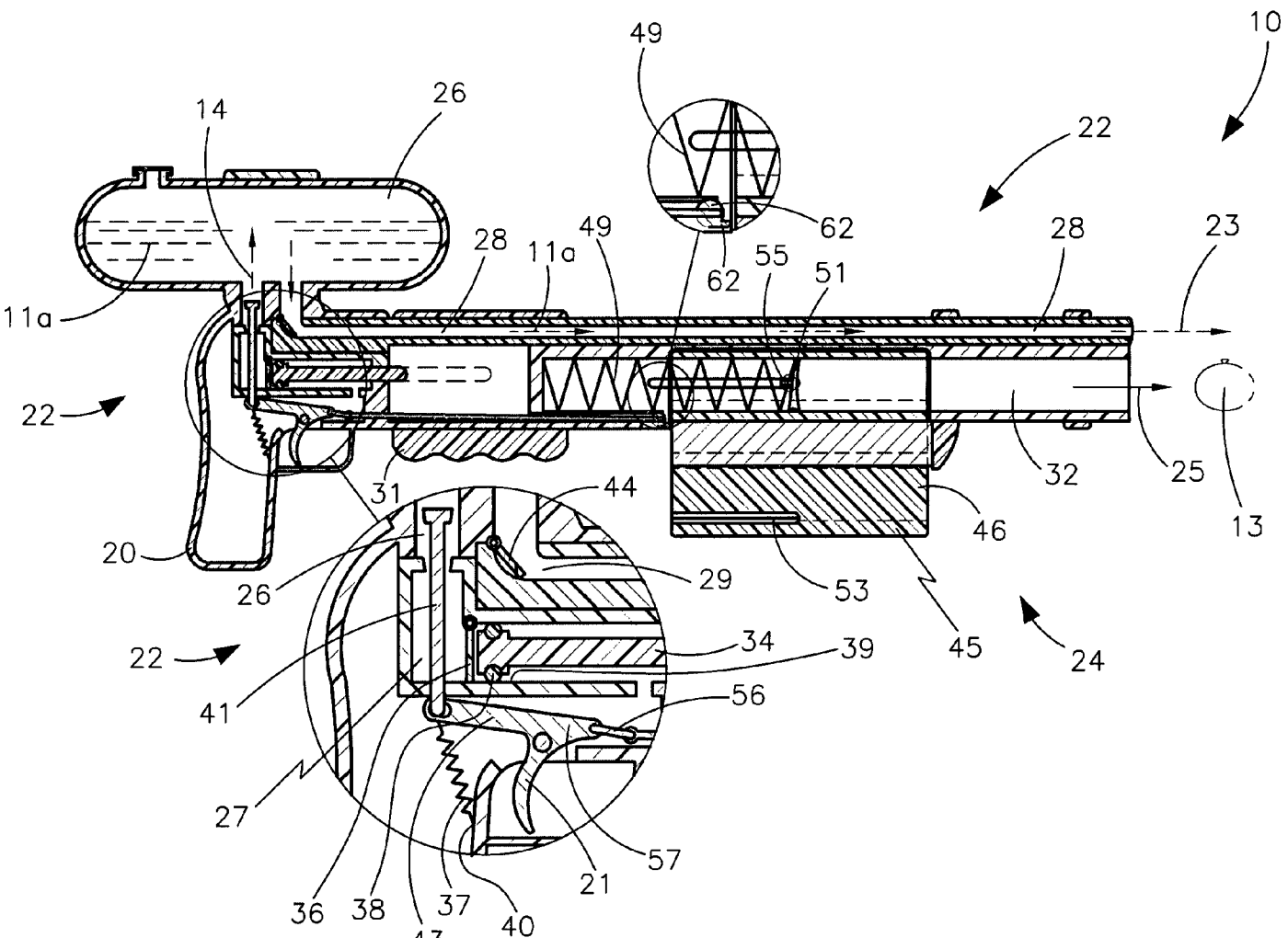
FIG. 7B is a cross sectional view of the present invention showing an exploded detailed view of the trigger and a detailed view of the hinge when the second plunger is in a released position and the first plunger is positioned at the proximate position.

Referring to FIGS. 7A and 7B, the water discharging mechanism 22 preferably includes a water-holding reservoir 26, containing a first volume of water 11A therein, mounted on the handle section 20. The water discharging mechanism 22 may also include an air-holding chamber 27 in fluid communication with the water-holding reservoir 26 for directing air 12 into the water-holding reservoir 26.

Additionally, a first barrel 28 is preferably coupled to the handle section 20. Such a first barrel 28 may include an inlet port 29 formed at a proximal end 30 thereof in fluid communication with the water-holding reservoir 26. In this manner, water may travel directly from the water-holding reservoir 26 to the first barrel 28 without interfering with the balloon's travel path. This valuable feature reduces the chances of malfunction from interference between the water balloon launching and water discharging mechanisms, respectively. Other inventions, for example, may feature a series of hoses and tubes through which water travels. In the event of a single hose or tube becoming disconnected, the entire invention becomes inoperable.

Referring again to FIGS. 7A and 7B, the water discharging mechanism 22 may also include a guard 31 slidably seated about the first 28 and second 32 barrels respectively. Such a guard 31 is preferably manually reciprocated along a linear path 33 extending parallel to the first 28 and second 32 barrels respectively. A first plunger 34 may be coupled to the guard 31. Such a first plunger 34 may also include a proximal end 35 telescopically reciprocated inside the air-holding chamber 27 as the guard 31 is linearly reciprocated towards and away from the handle 20.

A spring-tensioned first flap 36 may preferably be pivotally situated within the air-holding chamber 27 and situated along a corresponding travel path of the first plunger 34. Such a first flap 36 may be resiliently articulated along a first arcuate path when the first plunger 34 is proximally displaced within the air-holding chamber 27. The first plunger 34 may effectively force the first flap 36 to an open position when the first plunger 34 reaches a terminal end of the corresponding travel path such that air 14 is introduced into the air-holding chamber 27 and retained downstream of the first flap 36.

The first flap 36 may then automatically return to a closed equilibrium position as the first plunger 34 is retracted distally inside the air-holding chamber 27. This feature prevents air from leaking back upstream of the first flap and is thus conducive to building the necessary pressure to discharge a stream of water. Also, the guard may be reciprocated a number of times, enabling a user to create a small amount of pressure or a large amount of pressure, facilitating in varying levels of water discharge.

Referring to FIGS. 7A and 7B, the first plunger 34 preferably includes a washer 38 attached to an outer perimeter of the proximal end 35 thereof. Such a washer 38 may maintain continuous surface area contact with an interior wall 39 of the air-holding chamber 27 located upstream of the first flap 36 and is vital for maximizing air-displacement downstream of the first flap 36 during reciprocating movements of the first plunger 34. The proximal end 35 of the first plunger 34 may also advantageously remain permanently seated within the air-chamber 27 while guard 31 is linearly reciprocated towards and away from the air-holding chamber 27 respectively. The washer 38 location about the proximal end 35 of the first plunger 34 provide a benefit of reducing the requisite number of guard 31 pumping motions to effectively discharge water.

Referring to FIGS. 7A and 7B, the handle section 20 preferably includes a first spring member 37 anchored to the trigger 21 and an inner wall 40 of the handle section 20 respectively. The first spring member 37 may be linearly reciprocated between extended and equilibrium positions respectively defined along a travel path obliquely offset from the corresponding travel path 33 of the first plunger 34. A piston 41 is preferably slidably interfitted within the air-holding chamber 27. Such a piston 41 may maintain continuous contact with an inner wall 42 located downstream of the first flap 36.

The piston 41 may also be pivotally attached to a proximal end 43 of the trigger 21 and may further be linearly reciprocated along a corresponding travel path which is vital so that the piston 41 effectively permits air to escape out from the air-holding chamber 27 and directly enter the water-holding reservoir 26 when the piston 41 is elevated to a raised position. This is vital for activating the water discharging mechanism.

Referring to FIGS. 7A and 7B, the water discharging mechanism 22 preferably further includes a spring-tensioned second flap 44 pivotally connected to the first barrel 28. Such a second flap 44 may be situated at the inlet port 29. The second flap 44 may also remain closed at equilibrium and may further be resiliently biased to an open position when a second volume 11B of water is forced out of the water-holding reservoir 26 as air enters the water-holding reservoir 26. Conveniently, the second volume 11B of water is displaced along an entire longitudinal length of the first barrel 28. In this manner, the second volume of water is discharged along the first barrel and out of the device along the first trajectory.

Figure 7C:
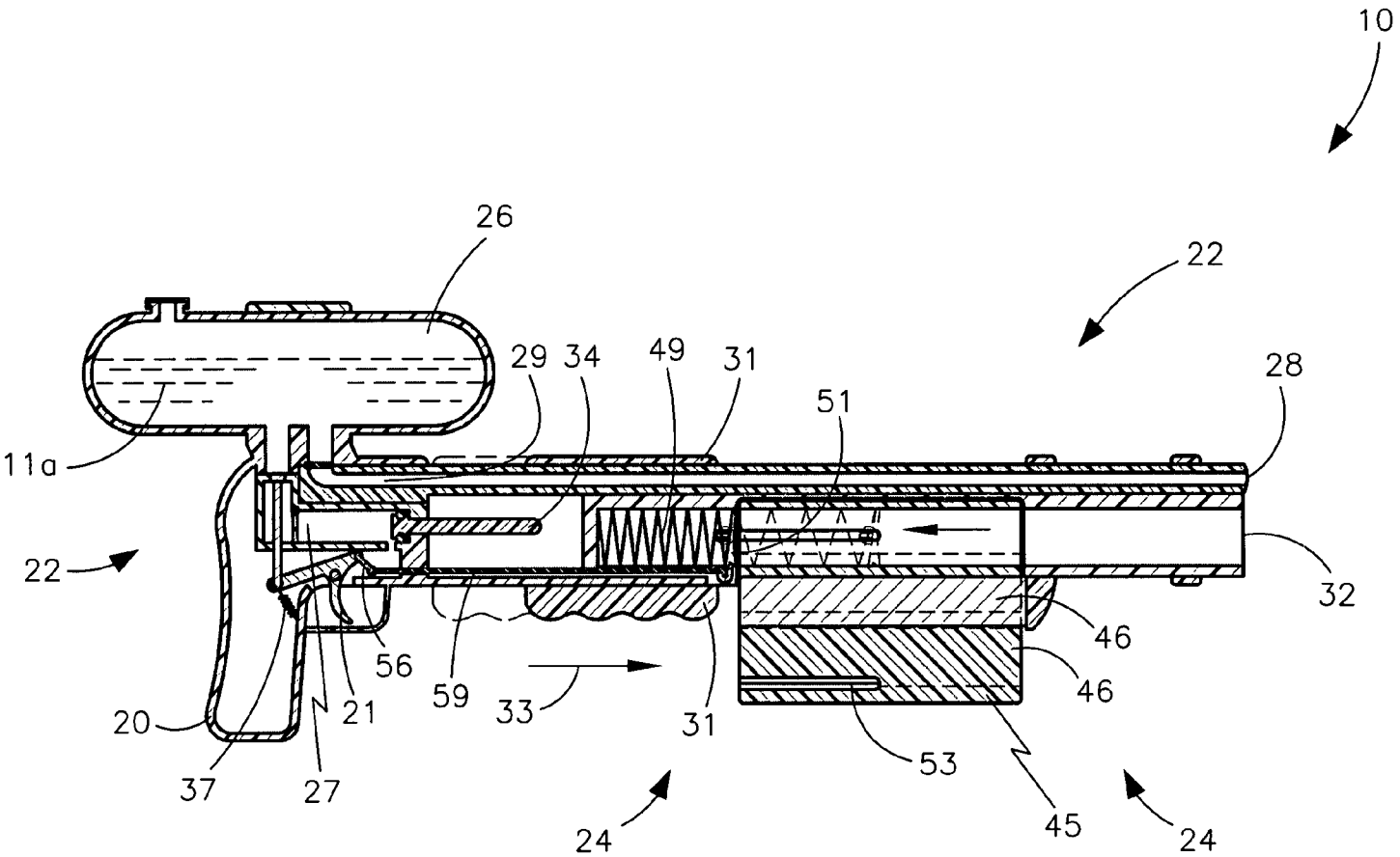
FIG. 7C is a cross sectional view of the present invention with the first plunger positioned distally away from the air-holding reservoir.

Referring to FIGS. 7A-7C, the water balloon launching mechanism 24 preferably includes a second barrel 32 extending parallel to the first barrel 22 which is isolated therefrom such that the first 11A and second 11B water volumes are prohibited from entering the second barrel 32. The water balloon launching mechanism 24 may also include a revolving water balloon-holding drum 45. Such a revolving drum 45 may include a plurality of isolated chambers 46 juxtaposed side-by-side along a circumferential path thereof.

Each of such chambers 46 preferably includes an open proximal end 48 selectively positioned within the second barrel 32 and independently oriented in line with the second trajectory 25 respectively The revolving drum 45 may be suitably sized and shaped for simultaneously holding one of the water balloons 13 within each of the chambers 46 respectively such that a new one of the chambers 46 becomes axially aligned along the second trajectory 25 when the revolving drum 45 is rotated along a mutually exclusive arcuate path 70. In this manner, each chamber 46 of the revolving drum 45 effectively becomes aligned with the second barrel 32, enabling a user to launch a series of water balloons without having to individually load each water balloon into the second barrel.

Referring to FIGS. 1-7C, the water balloon launching mechanism 24 preferably further includes a second spring member 49 anchored inside the second barrel 32. Such a second spring member 49 may be arranged to linearly reciprocate between associated compressed and equilibrium positions respectively defined along a linear travel path extending within the second barrel The water balloon launching mechanism 24 may also include a second plunger 51 slidably interfitted within the second barrel 32. Such a second plunger 51 is preferably directly attached with the use of intervening elements to a distal end of the second spring member 49. The second plunger 51 may further be displaced from the associated cocked position to an associated equilibrium position such that the second plunger 51 distally urges the water balloon 13 outwardly from the second barrel 32 and along the second trajectory 25 extending away from a corresponding one of the chambers 46 respectively.

The combined elements of the second spring member and the second plunger provide the necessary mechanics to launch the water balloon without puncturing or damaging the balloon. The water balloon launching mechanism 24 may also preferably include a plurality of linear slots 53 formed within an outer surface of the revolving drum 45 and traveling parallel to a longitudinal length of the chambers 46 respectively.

A plurality of reset levers 55 may traverse through the slots 53 and maintain direct abutment with the second plunger 51. Such reset levers 55 may proximally urge the second plunger 51 back to the cocked position when the reset levers 55 are linearly returned to a retracted position located proximal to the revolving drum 45. In this manner, a user may engage the water balloon launching mechanism from any one of the revolving drum chambers 46. This feature allows the user to launch consecutive balloons while only require the user to retract the rest levers and rotate the drum 45.

Referring to FIGS. 7A-7C, the water balloon launching mechanism 24 preferably further includes a ring 56 pivotally coupled to a distal end 57 of the trigger 21. Such a ring 56 may be biased along an arcuate path as the trigger 21 is toggled to and from the single cocked position. An elongated and linear actuating lever 59 may have a proximal end pivotally mated with the ring 56. Such an actuating lever 59 is preferably linearly reciprocated along a travel path registered parallel to the longitudinal length of the second barrel 32 as the ring 56 is biased along the arcuate path.

The water balloon launching mechanism 24 may further include a hinge 61 with a locking finger 62 releasably maintaining a frictional engagement with the second plunger 51. Such a locking finger 62 may be advantageously articulated to an unlocked position and thereby disengaged from the second plunger 51 when the actuating lever 59 is urged distally along the longitudinal length of the second barrel 32 such that the second plunger 51 is released from the corresponding cocked position and launches the water-balloon 13 along the second trajectory 25. The actuating lever 59 may automatically return to the retracted position while the locking finger 62 remains at the unlocked position.

The second plunger may effectively articulate the locking finger 62 back to the frictional engagement with the second plunger 51 when the reset levers 55 are returned to corresponding cocked positions respectively. The elements of the ring 56 and the actuating lever 59 combine to produce a user benefit wherein both mechanisms 22, 24 may be engaged from a single trigger 21. While the proximal end of the trigger 21 pulls the piston down, activating the water discharging mechanism 22, the distal end of the trigger 21 engages the ring 56, which in turn engages the actuating lever 59. This in turn activates the water balloon launching mechanism 24.

Users benefit by being able to shower each other with a cool stream of water as well as pelt each other with well aim of water balloons. Referring to FIGS. 7A-7C, the first plunger 34 is preferably located upstream of the second plunger 51 so that the first plunger 34 introduces air into the air-holding chamber 27 independent of whether the second plunger 51 is cocked or released. In this manner, a user may continue to reciprocate the guard 31 and introduce more air into the air holding chamber 27 while the reset levers 55 are retracted and the water balloon launching mechanism 24 is in a cocked position.

Thus, a user desiring to discharge water at a high rate of discharge may not be limited to reciprocating the guard 31 when the water balloon launching mechanism 24 is in an engaged position. Also, the configuration of the trigger 21 allows the user to independently activate any one of the mechanisms 22, 24. For example, water may be discharged from the water discharging mechanism 22 by activating the trigger while the water balloon launching mechanism 24 is not in a cocked position. Alternatively, a water balloon may be launched from the water balloon launching mechanism 24 by activating the trigger 21 before the guard 31 has been reciprocated.

In use, a method for launching a water balloon and discharging water device 10 may include the first step of providing a handle 20 section including a trigger 21 pivotally connected thereto. The method may also include the second step of providing a mechanism for discharging a stream of water 22 along a first trajectory 23. The method may further include the third step of providing a mechanism for launching a water balloon 24 along a second trajectory 25.

The method may further include the fourth step of simultaneously launching and discharging the water balloon 13 and the water along the first 23 and second 25 trajectories respectively when the trigger 21 is depressed to a single engaged position by automatically releasing the water discharging mechanism 22 and the water balloon launching mechanism 24 from corresponding cocked positions when the trigger 21 is depressed to the single engaged position.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A combined water balloon launcher and water discharging device for providing user enjoyment, said combined water balloon launcher and water discharging device comprising:

a handle section including a trigger pivotally connected thereto;

means for discharging a stream of water along a first trajectory; and means for launching a water balloon along a second trajectory;

wherein said water discharging means and said water balloon launching means are automatically released from corresponding cocked positions when said trigger is depressed to a single engaged position;

wherein said water discharging means comprises:

a water-holding reservoir mounted on said handle section, said water-holding reservoir containing a first volume of water therein;

an air-holding chamber in fluid communication with said water-holding reservoir for directing air into said water-holding reservoir; and a first barrel coupled to said handle section, said first barrel having an inlet port formed at a proximal end thereof and being in fluid communication with said reservoir;

wherein said water discharging means further comprises:

a guard slidably seated about said first and second barrels respectively, said guard being manually reciprocated along a linear path extending parallel to said first and second barrels respectively;

a first plunger coupled to said guard and having a proximal end telescopically reciprocated inside said air-holding chamber as said guard is linearly reciprocated towards and away from said handle; and a spring-tensioned first flap pivotally situated within said air-holding chamber and being situated along a corresponding travel path of said first plunger, said first flap being resiliently articulated along a first arcuate path when said first plunger proximally displaced within said air-holding chamber;

wherein said first plunger forces said first flap to an open position when said first plunger reaches a terminal end of said corresponding travel path such that air is introduced into said air-holding chamber and retained downstream of said first flap, said first flap automatically returning to a closed equilibrium position as said first plunger is retracted distally inside said air-holding chamber;

wherein said handle section comprises:

a first spring member anchored to said trigger and an inner wall of said handle section respectively, said first spring member being linearly reciprocated between extended and equilibrium positions respectively defined along a travel path obliquely offset from said corresponding travel path of said first plunger; and a piston slidably interfitted within said air-holding chamber and maintaining continuous contact with an inner wall located downstream of said first flap;

wherein said piston is pivotally attached to a proximal end of said trigger and is further linearly reciprocated along a corresponding travel path such that said piston permits air to escape out from said air-holding chamber and directly enter said reservoir when said piston is elevated to a raised position.

2. The combined water balloon launcher and water discharging device of claim 1, wherein said water discharging means further comprises:

a spring-tensioned second flap pivotally connected to said first barrel and being situated at said inlet port, said second flap remaining closed at equilibrium and being resiliently biased to an open position when a second volume of water is forced out of said reservoir as air enters said reservoir;

wherein said second volume of water is displaced along an entire longitudinal length of said first barrel.

3. The combined water balloon launcher and water discharging device of claim 2, wherein said first plunger comprises:

a washer attached to an outer perimeter of said proximal end of said first plunger for maintaining continuous surface area contact with an interior wall of said air-holding chamber located upstream of said first flap and thereby maximizing air-displacement downstream of said first flap during reciprocating movements of said first plunger;

wherein said proximal end of said first plunger remains permanently seated within said air-chamber while guard is linearly reciprocated towards and away from said air-holding chamber respectively.

4. The combined water balloon launcher and water discharging device of claim 3, wherein said water balloon launching means comprises:

a second barrel extending parallel to said first barrel and being isolated therefrom such that said first and second water volumes are prohibited from entering said second barrel; and a revolving water balloon-holding drum having a plurality of isolated chambers juxtaposed side-by-side along a circumferential path of said revolving drum, each of said chambers having an open proximal end selectively positioned within said second barrel and independently oriented in line with said second trajectory respectively, said revolving drum being suitably sized and shaped for simultaneously holding one of the water balloons within each of said chambers respectively such that a new one of said chambers becomes axially aligned along said second trajectory when said revolving drum is rotated.

5. The combined water balloon launcher and water discharging device of claim 4, wherein said water balloon launching means further comprises:

a second spring member anchored inside said second barrel and arranged to linearly reciprocate between associated compressed and equilibrium positions respectively defined along a linear travel path extending within said second barrel; and a second plunger slidably interfitted within said second barrel, said second plunger being directly attached to a distal end of said second spring member and further being displaced from said associated cocked position to an associated equilibrium position such that said second plunger distally urges the water balloon outwardly from said second barrel and along said second trajectory extending away from a corresponding one of said chambers respectively;

a plurality of linear slots formed within an outer surface of said revolving drum and traveling parallel to a longitudinal length of said chambers respectively; and a plurality of reset levers traversing through said slots and maintaining direct abutment with said second plunger, said reset levers proximally urging said second plunger back to said cocked position when said reset levers are linearly returned to a retracted position located proximal to said revolving drum.

6. The combined water balloon launcher and water discharging device of claim 5, further comprising:

a ring pivotally coupled to a distal end of said trigger, said ring being biased along an arcuate path as said trigger is toggled to and from said single cocked position;

an elongated and linear actuating lever having a proximal end pivotally mated with said ring, said actuating lever being linearly reciprocated along a travel path registered parallel to said longitudinal length of said second barrel as said ring is biased along said arcuate path; and a hinge having a locking finger releasably maintaining a frictional engagement with said second plunger;

wherein said locking finger is articulated to an unlocked position and thereby disengaged from said second plunger when said actuating lever is urged distally along said longitudinal length of said second barrel such that said second plunger is released from said corresponding cocked position and launches the water-balloon along said second trajectory;

wherein said actuating lever automatically returns to said retracted position while said locking finger remains at said unlocked position, said second plunger articulating said locking finger back to the frictional engagement with said second plunger when said reset levers are returned to corresponding cocked positions respectively.

7. The combined water balloon launcher and water discharging device of claim 6, wherein said first plunger is located upstream of said second plunger so that said first plunger introduces air into said air-holding chamber independent of whether said second plunger is cocked or released.

8. A combined water balloon launcher and water discharging device for providing user enjoyment, said combined water balloon launcher and water discharging device comprising:

a handle section including a trigger pivotally connected thereto;

means for discharging a stream of water along a first trajectory; and means for launching a water balloon along a second trajectory;

wherein said water discharging means and said water balloon launching means are automatically released from corresponding cocked positions when said trigger is depressed to a single engaged position;

wherein the water balloon and the water are simultaneously launched and discharged along said first and second trajectories respectively when said trigger is depressed to said single engaged position;

wherein said water discharging means comprises:

a water-holding reservoir mounted on said handle section, said water-holding reservoir containing a first volume of water therein;

an air-holding chamber in fluid communication with said water-holding reservoir for directing air into said water-holding reservoir; and a first barrel coupled to said handle section, said first barrel having an inlet port formed at a proximal end thereof and being in fluid communication with said reservoir;

wherein said water discharging means further comprises:

a guard slidably seated about said first and second barrels respectively, said guard being manually reciprocated along a linear path extending parallel to said first and second barrels respectively;

a first plunger coupled to said guard and having a proximal end telescopically reciprocated inside said air-holding chamber as said guard is linearly reciprocated towards and away from said handle; and a spring-tensioned first flap pivotally situated within said air-holding chamber and being situated along a corresponding travel path of said first plunger, said first flap being resiliently articulated along a first arcuate path when said first plunger proximally displaced within said air-holding chamber;

wherein said first plunger forces said first flap to an open position when said first plunger reaches a terminal end of said corresponding travel path such that air is introduced into said air-holding chamber and retained downstream of said first flap, said first flap automatically returning to a closed equilibrium position as said first plunger is retracted distally inside said air-holding chamber;

wherein said handle section comprises:

a first spring member anchored to said trigger and an inner wall of said handle section respectively, said first spring member being linearly reciprocated between extended and equilibrium positions respectively defined along a travel path obliquely offset from said corresponding travel path of said first plunger; and a piston slidably interfitted within said air-holding chamber and maintaining continuous contact with an inner wall located downstream of said first flap;

wherein said piston is pivotally attached to a proximal end of said trigger and is further linearly reciprocated along a corresponding travel path such that said piston permits air to escape out from said air-holding chamber and directly enter said reservoir when said piston is elevated to a raised position.

9. The combined water balloon launcher and water discharging device of claim 8, wherein said water discharging means further comprises:

a spring-tensioned second flap pivotally connected to said first barrel and being situated at said inlet port, said second flap remaining closed at equilibrium and being resiliently biased to an open position when a second volume of water is forced out of said reservoir as air enters said reservoir;

wherein said second volume of water is displaced along an entire longitudinal length of said first barrel.

10. The combined water balloon launcher and water discharging device of claim 9, wherein said first plunger comprises:

a washer attached to an outer perimeter of said proximal end of said first plunger for maintaining continuous surface area contact with an interior wall of said air-holding chamber located upstream of said first flap and thereby maximizing air-displacement downstream of said first flap during reciprocating movements of said first plunger;

wherein said proximal end of said first plunger remains permanently seated within said air-chamber while guard is linearly reciprocated towards and away from said air-holding chamber respectively.

11. The combined water balloon launcher and water discharging device of claim 10, wherein said water balloon launching means comprises:

a second barrel extending parallel to said first barrel and being isolated therefrom such that said first and second water volumes are prohibited from entering said second barrel; and a revolving water balloon-holding drum having a plurality of isolated chambers juxtaposed side-by-side along a circumferential path of said revolving drum, each of said chambers having an open proximal end selectively positioned within said second barrel and independently oriented in line with said second trajectory respectively, said revolving drum being suitably sized and shaped for simultaneously holding one of the water balloons within each of said chambers respectively such that a new one of said chambers becomes axially aligned along said second trajectory when said revolving drum is rotated.

12. The combined water balloon launcher and water discharging device of claim 11, wherein said water balloon launching means further comprises:

a second spring member anchored inside said second barrel and arranged to linearly reciprocate between associated compressed and equilibrium positions respectively defined along a linear travel path extending within said second barrel; and a second plunger slidably interfitted within said second barrel, said second plunger being directly attached to a distal end of said second spring member and further being displaced from said associated cocked position to an associated equilibrium position such that said second plunger distally urges the water balloon outwardly from said second barrel and along said second trajectory extending away from a corresponding one of said chambers respectively;

a plurality of linear slots formed within an outer surface of said revolving drum and traveling parallel to a longitudinal length of said chambers respectively; and a plurality of reset levers traversing through said slots and maintaining direct abutment with said second plunger, said reset levers proximally urging said second plunger back to said cocked position when said reset levers are linearly returned to a retracted position located proximal to said revolving drum.

13. The combined water balloon launcher and water discharging device of claim 12, further comprising:

a ring pivotally coupled to a distal end of said trigger, said ring being biased along an arcuate path as said trigger is toggled to and from said single cocked position;

an elongated and linear actuating lever having a proximal end pivotally mated with said ring, said actuating lever being linearly reciprocated along a travel path registered parallel to said longitudinal length of said second barrel as said ring is biased along said arcuate path; and a hinge having a locking finger releasably maintaining a frictional engagement with said second plunger;

wherein said locking finger is articulated to an unlocked position and thereby disengaged from said second plunger when said actuating lever is urged distally along said longitudinal length of said second barrel such that said second plunger is released from said corresponding cocked position and launches the water-balloon along said second trajectory;

wherein said actuating lever automatically returns to said retracted position while said locking finger remains at said unlocked position, said second plunger articulating said locking finger back to the frictional engagement with said second plunger when said reset levers are returned to corresponding cocked positions respectively.

* * * * *